US008905078B2

(12) United States Patent
Lee et al.

(10) Patent No.: US 8,905,078 B2
(45) Date of Patent: Dec. 9, 2014

(54) METHOD OF CONTROLLING WATER DROPLET MOVEMENT USING MICROFLUIDIC DEVICE

(75) Inventors: Hae-Shin Lee, Daejeon (KR); In-Seong You, Chungcheongnam-do (KR); Sung-Min Kang, Incheon (KR)

(73) Assignee: Korea Advanced Institute of Science and Technology, Daejeon (KR)

( * ) Notice: Subject to any disclaimer, the term of this patent is extended or adjusted under 35 U.S.C. 154(b) by 302 days.

(21) Appl. No.: 13/282,817

(22) Filed: Oct. 27, 2011

(65) Prior Publication Data

US 2013/0081698 A1 Apr. 4, 2013

(30) Foreign Application Priority Data

Sep. 30, 2011 (KR) ..... 10-2011-0100041

(51) Int. Cl.

| | |
|---|---|
| ***F15D 1/00*** | (2006.01) |
| ***F15C 1/06*** | (2006.01) |
| ***B01L 3/00*** | (2006.01) |
| ***F15D 1/02*** | (2006.01) |

(52) U.S. Cl.

CPC ..... *F15D 1/02* (2013.01); *B01L 2400/088* (2013.01); *B01L 2400/0457* (2013.01); *B01L 2300/0816* (2013.01); *B01L 2300/0867* (2013.01); *B01L 3/50273* (2013.01); *B01L 2400/0406* (2013.01); *B01L 2300/166* (2013.01); *B01L 2300/089* (2013.01)

USPC ..... 137/833; 137/38; 137/602

(58) Field of Classification Search

USPC ..... 137/38, 602, 833, 896; 366/179.1, 366/181.5, 182.1; 417/211

See application file for complete search history.

(56) References Cited

U.S. PATENT DOCUMENTS

| | | | | |
|---|---|---|---|---|
| 2,969,761 | A * | 1/1961 | Youtie | 114/183 A |
| 6,096,532 | A * | 8/2000 | Armstrong et al. | 435/286.5 |
| 6,196,805 | B1 * | 3/2001 | Reilley | 417/53 |
| 6,767,706 | B2 * | 7/2004 | Quake et al. | 435/6.13 |
| 7,393,391 | B2 | 7/2008 | Lopez et al. | |
| 7,833,486 | B2 * | 11/2010 | Fielden et al. | 422/502 |
| 7,919,180 | B2 * | 4/2011 | Furukawa | 428/336 |
| 2007/0166513 | A1 * | 7/2007 | Sheng et al. | 428/141 |
| 2009/0165320 | A1 * | 7/2009 | DeSimone et al. | 33/700 |
| 2010/0225685 | A1 * | 9/2010 | Kwon et al. | 347/9 |
| 2011/0033663 | A1 * | 2/2011 | Svec et al. | 428/141 |

OTHER PUBLICATIONS

George M. Whitesides, "The origins and the future of microfluidics", Nature, Jul. 27, 2006, pp. 368-373, vol. 442.

Todd Thorsen et al., "Microfluidic Large-Scale Integration", Science, Oct. 18, 2002, pp. 580-584, vol. 298.

Philippe Lam et al., "Surface-Tension-Confined Microfluidics", Langmuir, 2002, pp. 948-951, vol. 18, American Chemical Society.

(Continued)

*Primary Examiner* — John Rivell

*Assistant Examiner* — Seth W Mackay-Smith

(74) *Attorney, Agent, or Firm* — Sherr & Jiang, PLLC

(57) ABSTRACT

Provided is a method of controlling water droplet movement including providing a substrate including a superhydrophobic surface on which a hydrophilic channel guiding water droplet movement is patterned, introducing a water droplet on the substrate, and modulating a slope of the superhydrophobic surface for the water droplet to move on the superhydrophobic surface along the hydrophilic channel. Here, a width of the hydrophilic channel is modulated for the water droplet to move on the superhydrophobic surface having a certain angle with respect to a ground.

18 Claims, 10 Drawing Sheets

(56) References Cited

OTHER PUBLICATIONS

Hartmut Gau et al., "Liquid Morphologies on Structured Surfaces: From Microchannels to Microchips", Science, Jan. 1, 1999, pp. 46-49, vol. 283.
Bin Zhao et al., "Surface-Directed Liquid Flow Inside Microchannels", Science, Feb. 9, 2001, pp. 1023-1026, vol. 291.
Michael J. Swickrath et al., "The design and fabrication of autonomous polymer-based surface tension-confined . . . ", Microfluid Nanofluid, 2008, pp. 601-611, vol. 4.
Shih-Hui Chao et al., "Spontaneous, oscillatory liquid transport in surface tension-confined microfluidics", Lab Chip, 2009, pp. 867-869, vol. 9.
Michael Grunze, "Driven Liquids", Science, Jan. 1, 1999, pp. 41-42, vol. 283, No. 5398.
Salim Bouaidat et al., "Surface-directed capillary system; theory, experiments and applications", Lab Chip, 2005, pp. 827-836, vol. 5.
N. J. Shirtcliffe et al., "Learning from Superhydrophobic Plants: The Use of Hydrophilic Areas on Superhydrophobic Surfaces . . . ", Langmuir, 2009, pp. 14121-14128, vol. 25.
Xinjian Feng et al., "Reversible Super-hydrophobicity to Superhydrophilicity Transition of Aligned ZnO Nanorod Films", J. Am. Chem. Soc., 2004, pp. 62-63, vol. 126.
Nuno M. Oliveira et al., "Two-Dimensional Open Microfluidic Devices by Tuning the Wettability on Patterned Superhydrophobic . . . ", Applied Physics Express 3, 2010, 085205.
Woo Kyung Cho et al., "Water-repellent coating: formation of polymeric self-assembled monolayers on nanostructured surfaces", Nanotechnology 18, 2007, 395602.
Chang-Hwan Choi et al., "Large Slip of Aqueous Liquid Flow over a Nanoengineered Superhydrophobic Surface", Physical Review Letters, Feb. 17, 2006, 066001.
Haeshin Lee et al., "Mussel-Inspired Surface Chemistry for Multifunctional Coatings", Science, Oct. 19, 2007, pp. 426-430, vol. 318.
Falk Bernsmann et al., "Characterization of Dopamine-Melanin Growth on Silicon Oxide", J. Phys. Chem. C, 2009, pp. 8234-8242, vol. 113.
Sung Min Kang et al., "One-Step Modification of Superhydrophobic Surfaces by a Mussel-Inspired Polymer Coating", Angew. Chem. Int. Ed., 2010, pp. 9401-9404, vol. 49.
P. Roach et al., "Progress in Superhydrophobic Surface Development", Soft Matter, 2008, pp. 224-240, vol. 4, No. 2.
Xi Zhang et al., "Superhydrophobic surfaces: from structural control to functional application", Journal of Materials Chemistry, 2008, pp. 621-633, vol. 18.

* cited by examiner (a)

(b)

METHOD OF CONTROLLING WATER DROPLET MOVEMENT USING MICROFLUIDIC DEVICE

CROSS REFERENCE TO PRIOR APPLICATIONS

The present application claims priority under 35 U.S.C. §119 to Korean Patent Application No. 10-2011-0100041 (filed on Sep. 30, 2011), which is hereby incorporated by reference in its entirety.

TECHNICAL FIELD

The present invention relates to a method of controlling water droplet movement using a microfluidic device, and more particularly to a method of controlling water droplet movement which is a simple and environmentally friendly method capable of moving and stopping a water droplet on a superhydrophobic surface in a desired direction.

BACKGROUND

An on-surface microfluidic device controls fluid movement along a hydrophilic channel coated on a superhydrophobic surface. The device is expected as an alternative to overcome limits of a conventional microfluidic system based on a three-dimensional closed channel, for example, limits such that polydimethylsiloxane melts in an organic solvent and such a device is difficult to prepare or control since various factors such as a pump, valve and so forth should be satisfied. Mano et al., (2010) and Sagues et al. (2010) introduced a hydrophilic channel on a superhydrophobic surface through selective plasma treatment and silver deposition, and suggested a technique of flowing water through the hydrophilic channel. However, the hydrophilically functionalized part formed by the plasma treatment is not permanent; the hydrophilic properties are disappeared after a certain period of time. Thus, to achieve rapid mixing, modulation of a reaction time and scaling down of a reaction, a more stable and novel on-surface microfluidic technique capable of controlling water droplet-based microfluid is needed.

SUMMARY

One aspect of the present invention provides a method of controlling water droplet movement, which includes providing a superhydrophobic substrate surface on which a hydrophilic two-dimensional (2-D) channel guiding water droplet movement is patterned, introducing a water droplet on the substrate, and modulating a slope of the superhydrophobic surface for the water droplet to move on the superhydrophobic surface along the hydrophilic 2-D channel. Here, a width of the hydrophilic 2-D channel is modulated for the water droplet to move on the superhydrophobic surface having a certain angle with respect to a ground.

Another aspect of the present invention provides a method of controlling water droplet movement, which includes providing a microfluidic device in which a Y-shaped 2-D catecholamine channel is patterned on a superhydrophobic surface, and moving a first water droplet including a first material and a second water droplet including a second material along respective routes of the Y-shaped 2-D catecholamine channel due to gravity. Here, one of the water droplets is first captured on a specific region of the Y-shaped 2-D catecholamine channel, the other water droplet is combined with the previously captured droplet, thereby forming a coalescent water droplet, and the coalescent water droplet moves along a lower route of the Y-shaped 2-D catecholamine channel.

Still another aspect of the present invention provides a method of controlling water droplet movement, which includes providing a substrate including a superhydrophobic surface on which a first hydrophilic channel and a second hydrophilic channel meeting each other at one point and a third hydrophilic channel connected with the first and the second hydrophilic channels through the point are patterned, dropping a first water droplet and a second water droplet on the first hydrophilic channel and the second hydrophilic channel, respectively, and modulating a slope of the superhydrophobic surface to move the first and the second water droplets in a direction of the third hydrophilic channel along the first and the second hydrophilic channels. Here, the third hydrophilic channel includes a droplet capturing surface area capable of stopping and fixing the first or the second water droplet, and the first and the second water droplets are combined with each other on the droplet capturing surface area to form a third water droplet.

Yet another aspect of the present invention provides a microfluidic device, which includes a superhydrophobic surface, and a hydrophilic channel patterned on the superhydrophobic surface to move the water droplet due to gravity maintaining a superhydrophobic angle of the water droplet. Here, the hydrophilic channel includes a Y-shaped route for inputting each of two water droplets and outputting a coalescent water droplet formed by combination of the two water droplets, and one region of the route includes a droplet capturing surface area capable of fixing one of the two water droplets that first reaches the droplet capturing surface area, detaching the coalescent water droplet formed by combining the fixed water droplet and the other water droplet that arrives later due to a weight of the coalescent water droplet, and outputting the coalescent water droplet along the Y-shaped route.

Yet another aspect of the present invention also provides a microfluidic system, which includes a microfluidic device including a superhydrophobic surface on which a hydrophilic channel is patterned to move the water droplet maintaining a superhydrophobic angle of a water droplet, a water droplet provider for providing a water droplet on the microfluidic device, and an angle stage modulating a slope of the microfluidic device to move the water droplet due to gravity.

Yet another aspect of the present invention provides a method of controlling hydrophilic liquid droplet movement, which includes providing a superhydrophobic substrate surface on which a hydrophilic 2-D channel guiding hydrophilic liquid droplet movement is patterned, introducing a hydrophilic liquid droplet on the substrate, and modulating a slope of the superhydrophobic surface for the water droplet to move on the superhydrophobic surface along the hydrophilic 2-D channel. Here, a width of the hydrophilic 2-D channel is modulated for the hydrophilic liquid droplet to move on the superhydrophobic surface having a certain angle with respect to a ground.

The Summary is provided to introduce a selection of concepts in a simplified form that are further described below in the Detailed Description. The Summary is not intended to identify key features or essential features of the claimed subject matter, nor is it intended to be used as an aid in determining the scope of the claimed subject matter.

BRIEF DESCRIPTION OF THE DRAWINGS

The above and other objects, features and advantages of the present invention will become more apparent to those of ordinary skill in the art by describing in detail exemplary embodiments thereof with reference to the attached drawings, in which.

DETAILED DESCRIPTION

It will be readily understood that the components of the present disclosure, as generally described and illustrated in the Figures herein, could be arranged and designed in a wide variety of different configurations. Thus, the following more detailed description of the embodiments of apparatus and methods in accordance with the present disclosure, as represented in the Figures, is not intended to limit the scope of the disclosure, as claimed, but is merely representative of certain examples of embodiments in accordance with the disclosure. The presently described embodiments will be best understood by reference to the drawings, wherein like parts are designated by like numerals throughout. Moreover, the drawings are not necessarily to scale, and the size and relative sizes of the layers and regions may have been exaggerated for clarity.

As used in the description herein and throughout the claims, the following terms take the meanings explicitly associated herein, unless the context clearly dictates otherwise: the meaning of "a", "an", and "the" includes plural reference, the meaning of "in" includes "in" and "on". It will also be understood that when an element or layer is referred to as being "on" another element or layer, the element or layer may be directly on the other element or layer or intervening elements or layers may be present.

Figure 1:
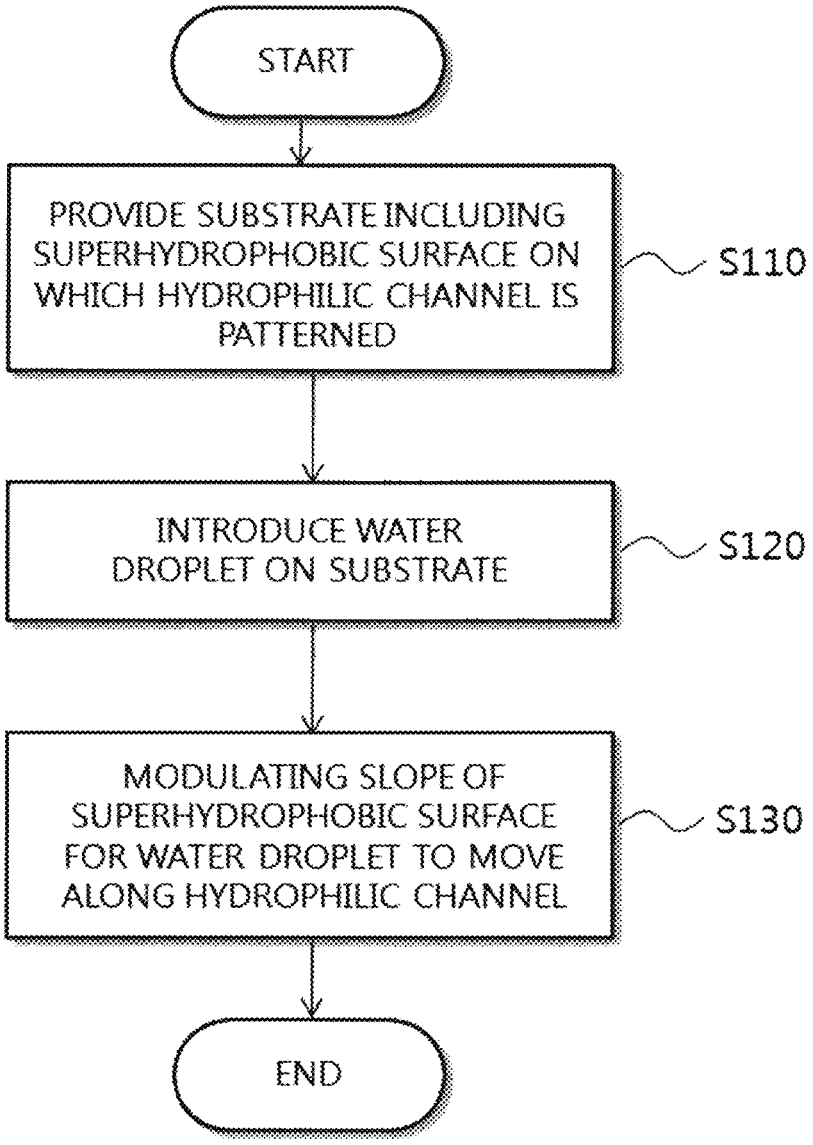
FIG. 1 is a process flowchart illustrating a method of controlling water droplet movement according to an exemplary embodiment of the present invention.

Hereinafter, the present invention will be described in further detail with reference to the drawings. FIG. 1 is a process flowchart illustrating a method of controlling water droplet movement according to an exemplary embodiment of the present invention. Referring to FIG. 1, in S110, a substrate including a superhydrophobic surface on which a hydrophilic channel guiding water droplet movement is patterned is provided.

The superhydrophobic surface on the substrate may be embodied by various known methods (P. Roach el al., *Soft Matter,* 2008, 4, 224-240; Xi Zhang el al., *J. Mater. Chem.,* 2008, 18, 621-633, etc.).

The superhydrophobic surface may be embodied by a method of changing a chemical composition of the surface or a method of geometrically changing a structure. In the former, a contact angle of 120 degrees or higher is difficult to realize, and thus the latter method increasing surface roughness is effective. For example, the superhydrophobic surface may be prepared by treating an aluminum anode oxidation (AAO) membrane with oxygen plasma and vapor depositing the membrane using a fluorine compound.

A hydrophilic channel is patterned on the superhydrophobic surface to form a moving route of a water droplet. The hydrophilic channel may be coated with unlimitedly various kinds of hydrophilic materials. For example, the hydrophilic channel may include a monomeric or a polymeric coating of hydroxybenzenes or catecholamines. An monomer or a polymer of hydroxybenzenes or catecholamines may be easily coated on various materials including noble metals, metal oxides, ceramics and synthetic polymers due to an excellent surface characteristic. When the monomeric or the polymeric coating of hydroxybenzenes or catecholamines is used to hydrophilize a superhydrophobic surface, the surface may be more simply hydrophilized than a conventional physical or chemical method, and the hydrophilized surface may be semipermanently conserved without returning to the original state, that is, the hydrophobic surface. Specific examples of the monomer or the polymer of hydroxybenzenes or catecholamines may include, but are not limited to, dopamine, norepinephrine, pyrogallolamine, DOPA (3,4-Dihydroxyphenylalanine), catechin, tannins, pyrogallol, pyrocatechol, heparin-catechol, chitosan-catechol, poly(ethylene glycol)-catechol, poyl(ethyleneimine)-catechol, poly(methylmethacrylate)-catechol, hyaluronic acid-catechol, etc. The superhydrophobic surface may be hydrophilized by one-step solution-based surface treatment. For example, as the substrate having the superhydrophobic surface is dipped in a solution containing dopamine, the superhydrophobic surface may be changed into a hydrophilic surface by polydopamine coating. Here, the polydopamine coating may be formed by oxidative self-polymerization of dopamine.

Figure 2:
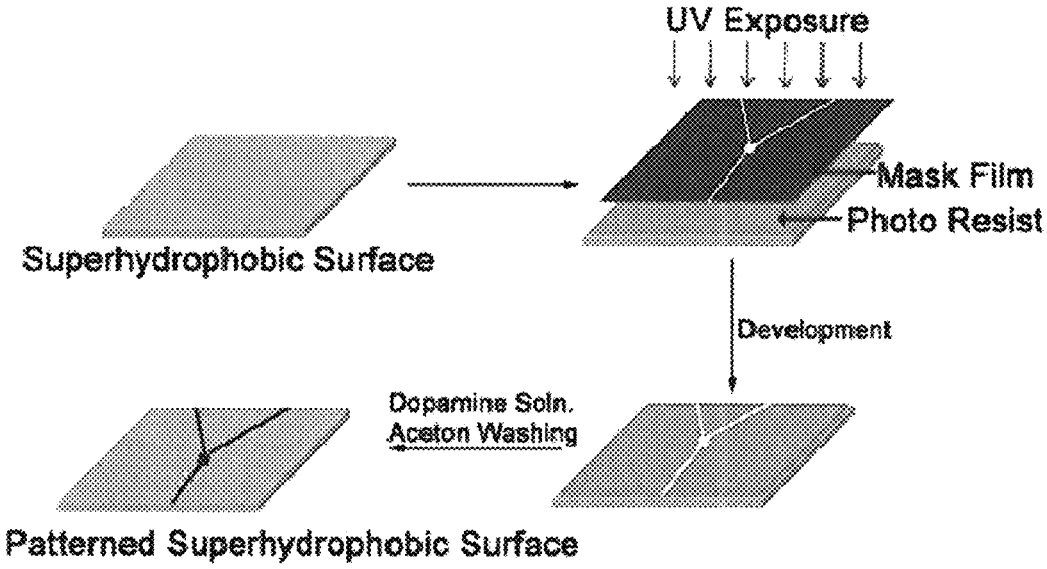
FIG. 2 illustrates a process of coating a superhydrophobic surface formed by aluminum anodization with a hydrophilic material using photolithography.

When the hydrophilic channel is formed by being coated with a hydrophilic material as described above, various known patterning techniques may be used to form a micropattern. FIG. 2 illustrates a process of coating the superhydrophobic surface fabricated by aluminum anodization with a hydrophilic material using photolithography. Referring to FIG. 2, a photoresist is first applied to the substrate having the superhydrophobic surface and then the substrate is exposed to UV rays through a Y-shaped mask film. The substrate is developed, and a photoresist layer patterned in a Y shape is obtained. When the substrate is dipped in a dopamine solution for several hours and washed with acetone, a superhydrophobic surface patterned with hydrophilic channel composed of polydopamine may be obtained. When the hydrophilic channel is patterned on the superhydrophobic surface, water droplets may move along a route guided by the hydrophilic channel.

Referring again to FIG. 1, in S120, a water droplet is introduced on the substrate. The introduction of the water droplet may be performed by a method of dropping water using a microburette.

In S130, the water droplet movement may be controlled by moving the water droplet on the superhydrophobic surface along the hydrophilic channel by modulating a slope of the superhydrophobic surface.

The movement of the water droplet may be caused by gravity. As an angle of the superhydrophobic surface with respect to a ground is achieved at a certain point, the water droplet rolls down toward the ground along the superhydrophobic surface. Here, by modulating a width of the hydrophilic channel, the water droplet may maintain a spherical shape while moving along the hydrophilic channel. When a width of the hydrophilic channel is excessively large, the water droplet may not maintain a spherical shape and may be attached to the hydrophilic channel with low contact angle. Therefore, the water droplet may not move.

Figure 3:
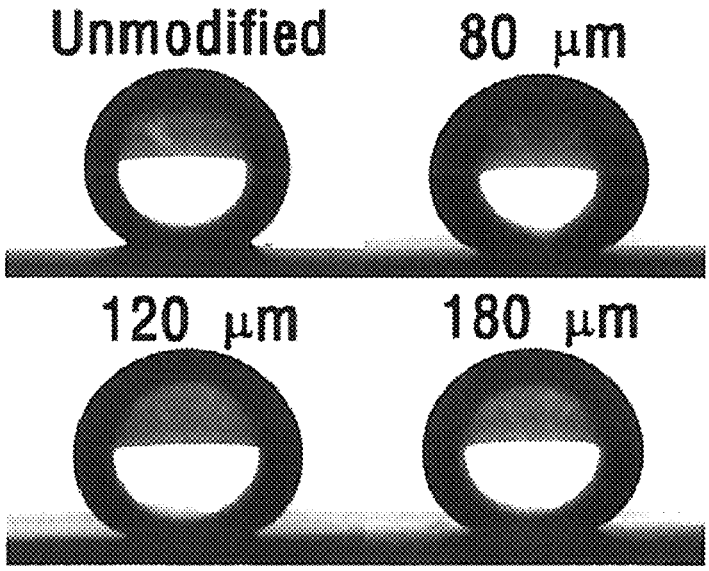
FIG. 3 illustrates contact angles of water with respect to an unmodified superhydrophobic surface and superhydrophobic surfaces including hydrophilic channels having various widths (80, 120 and 180 μm) coated with polydopamine.

FIG. 3 illustrates contact angles of water with respect to an unmodified superhydrophobic surface and superhydrophobic surfaces including polydopamine-coated hydrophilic channels having various widths. Referring to FIG. 3, it can be seen that the water droplet on the polydopamine coating continuously maintains a superhydrophobic angle like a water droplet on an untreated superhydrophobic surface without significant change in a contact angle even when the width of the hydrophilic channel coated with polydopamine is increased.

According to an exemplary embodiment of the present invention, a part of the hydrophilic channel may include a droplet capturing surface area having a longer edge length in contact with the water droplet than that of the hydrophilic channel in order to stop and fix the moving water droplet. When the water droplet is fixed to the droplet capturing surface area, another water droplet besides the water droplet may move along the hydrophilic channel to be coalesced with the water droplet to form a coalescent water droplet in the droplet capturing surface area. The coalescent water droplet may be separated from the droplet capturing surface area due to a weight increase of the coalescent water droplet and move along the remaining hydrophilic channel. The water droplet may maintain a superhydrophobic contact angle on the superhydrophobic surface despite the presence of the hydrophilic channel. In detail, the water droplet may maintain a contact angle of 120 degrees or higher, preferably 140 degrees or higher, and more preferably 150 degrees or higher on the superhydrophobic surface.

Figure 4:
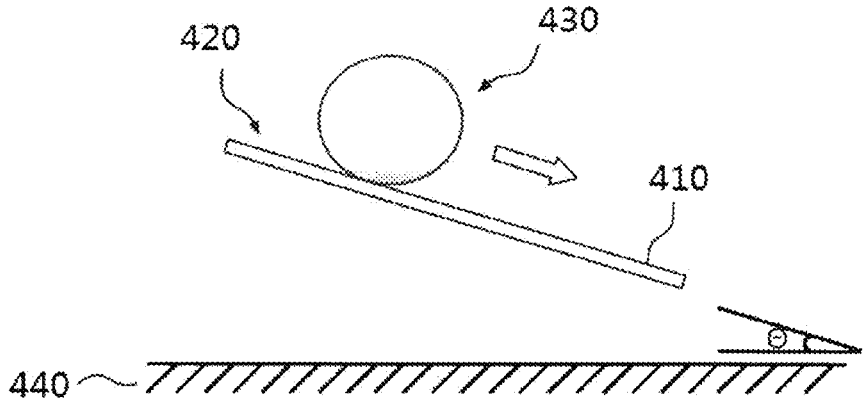
FIG. 4 is a diagram of a water droplet moving on a superhydrophobic surface along a hydrophilic channel. (a) is a side view of water droplet movement when the superhydrophobic surface has an angle of θ with respect to a ground, and (b) illustrates a plane view (left) and a front view (right) showing an edge length of a water droplet contacted hydrophilic channel.
Figure 4:
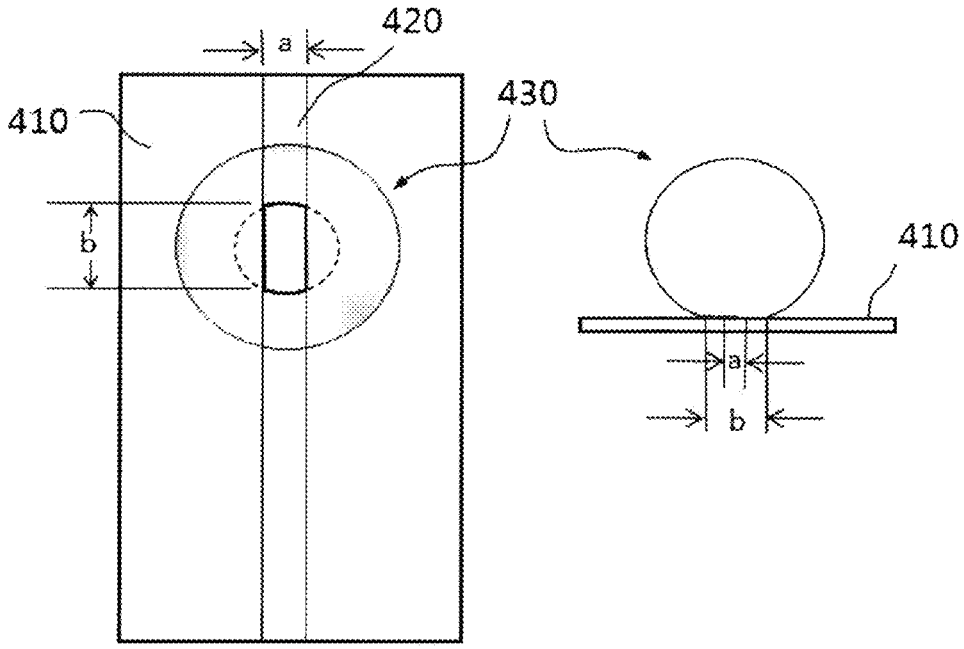

FIG. 4 is a diagram of a water droplet moving on a superhydrophobic surface along a hydrophilic channel. (a) is a side view of water droplet movement when the superhydrophobic surface has an angle of θ with respect to a ground, and (b) illustrates a plan view (left) and a front view (right) showing an edge length of a hydrophilic channel in contact with a water droplet.

Referring to (a) of FIG. 4, a hydrophilic channel 420 patterned on a superhydrophobic surface 410 may provide a traction force to a water droplet 430 moving on the superhydrophobic surface 410. When an angle θ between the superhydrophobic surface 410 and a ground 440 is smaller than a predetermined value, the water droplet 430 may not move due to the traction force caused by the hydrophilic channel 420, and when the angle θ is larger than the predetermined value, the water droplet may roll down. When a critical angle $\theta_{cr}$ at which the water droplet 430 starts to roll down by changing a slope of the superhydrophobic surface 410 is measured, the maximum static traction F may be calculated as in the following Equation 1.

$$F=mg\sin\theta_{cr} \quad \text{(Equation 1)}$$

m: mass of water droplet, g: acceleration of gravity, $\theta_{cr}$: critical angle Therefore, a slope of the superhydrophobic surface 410 may be modulated to control movement and fixation of the water droplet 430.

Referring to (b) of FIG. 4, a state when the water droplet 430 is disposed on the superhydrophobic surface 410 is shown. A circle drawn with a dotted line indicates a region in which the water droplet 430 is in contact with the superhydrophobic surface 410. The edge length of the hydrophilic channel 420 in contact with the water droplet 430 is drawn with a thick solid line, and has a size of approximately 2(a+b). Although exaggeratedly shown in the drawing, a width a of the hydrophilic channel 420 is several tens of micrometers, which is much smaller than b. Therefore, an actual edge length is approximately 2b.

When the edge length of the hydrophilic channel 420 in contact with the water droplet 430 becomes longer, the maximum static traction F may be increased. That is, when a width of the hydrophilic channel 420 becomes larger, the edge length acting on the water droplet 430 becomes longer and thus the traction force may be increased. Therefore, the edge length of the hydrophilic channel 420 in contact with the water droplet 430 may be modulated in order to control the movement and fixation of the water droplet 430.

Figure 5:
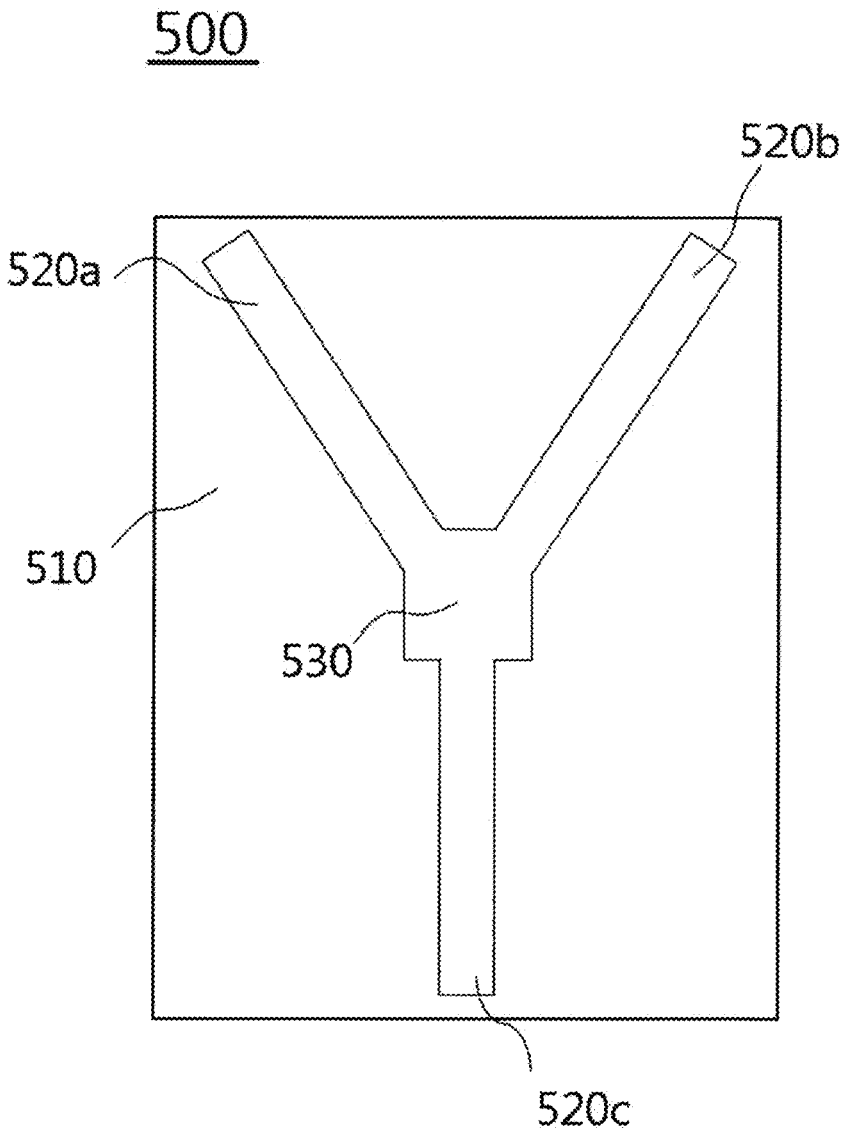
FIG. 5 is a diagram of a microfluidic device according to an exemplary embodiment of the present invention.

According to an exemplary embodiment of the present invention, a microfluidic device including a hydrophilic channel patterned in a Y-shaped route on a superhydrophobic surface is provided. FIG. 5 is a diagram of a microfluidic device according to an exemplary embodiment of the present invention. Referring to FIG. 5, a microfluidic device 500 includes a superhydrophobic surface 510 and a hydrophilic channel 520. The hydrophilic channel 520 is patterned on the superhydrophobic surface 510 for a water droplet to maintain a superhydrophobic angle and move by gravity along a predetermined route.

The hydrophilic channel 520 includes a Y-shaped route for individual input of two water droplets and output of a coalescent water droplet formed by combining the two water droplets. Herein, the Y-shaped route means a route including branched input routes and one output route formed by combining the individual input routes. The input routes may be two or more, each having a linear or curved shape. The hydrophilic channel 520 may include a first hydrophilic channel 520*a*, a second hydrophilic channel 520*b* and a third hydrophilic channel 520*c*. The third hydrophilic channel 520*c* starts at one point at which the first and the second hydrophilic channels 520*a* and 520*b* meet, and at this point, the first and the second hydrophilic channels 520*a* and 520*b* are connected.

An edge length of the hydrophilic channel in contact with the water droplet may be modulated to control the movement and fixation of the water droplet. The edge length may be increased as a width of the hydrophilic channel is increased.

The water droplet movement may be controlled, for example, by the following method using a microfluidic device 500. A first water droplet and a second water droplet are dropped on a first hydrophilic channel 520*a* and a second hydrophilic channel 520*b*, respectively, and a slope of a superhydrophobic surface 510 is modulated. The first and the second water droplets may move toward the third hydrophilic channel 520*c* along the first hydrophilic channel 520*a* and the second hydrophilic channel 520*b* due to gravity, respectively. The third hydrophilic channel 520*c* includes a droplet capturing surface area 530. The droplet capturing surface area 530 may be disposed in the middle of the third hydrophilic channel 520*c* or at a point at which the third hydrophilic channel

520*c* starts as shown in FIG. 5, that is, a point at which the first and the second hydrophilic channels 520*a* and 520*b* meet.

The droplet capturing surface area 530 may provide a great traction force to stop and fix one water droplet moving along the channels 520*a* and 520*b*. After one of the first and the second water droplets reaching the droplet capturing surface area 530 is first fixed, it is combined with the water droplet reaching the droplet capturing surface area 530 later, thereby forming a third water droplet. After the third water droplet is formed, the third water droplet may be immediately detached from the droplet capturing surface area 530 and move along the third hydrophilic channel 520*c* due to its weight. The droplet capturing surface area 530 may have a longer edge length in contact with a water droplet than edge lengths of the first and the second hydrophilic channels 520*a* and 520*b* in order to stop and fix the first and the second water droplets. A coalescent water droplet may be formed by combining another water droplet with the third water droplet. The coalescent water droplet may be detached from the droplet capturing surface area and move along the third hydrophilic channel.

According to an exemplary embodiment, a larger number of water droplets other than the first and the second water droplets may move through more hydrophilic channels other than the first and the second hydrophilic channels 520*a* and 520*b*, and may be combined with the third water droplet in the droplet capturing surface area 530. In this case, a size of the droplet capturing surface area 530 may be larger such that a larger number of water droplets, in addition to these two water droplets, are combined and then detached from the droplet capturing surface area 530.

The microfluidic device 500 may include at least two droplet capturing surface areas for a continuous channel. In this case, a sequence in which two water droplets are combined in a first droplet capturing surface area, the coalescent water droplet rolls down to the ground and stopped in a second droplet capturing surface area, another water droplet is additionally combined with the above-mentioned coalescent water droplet in the second droplet capturing surface area, and the final water droplet rolls down to the ground may be repeated.

According to an exemplary embodiment of the present invention, a method of controlling water droplet movement using a microfluidic device having a Y-shaped polydopamine channel patterned on a superhydrophobic surface is provided.

Here, a first water droplet including a first material and a second water droplet including a second material may move along separated routes of the Y-shaped polydopamine channel due to gravity. One of the first and the second water droplets may be first fixed in one region of the Y-shaped polydopamine channel, and the other water droplet may meet the previously fixed water droplet, thereby forming a coalescent water droplet. The coalescent water droplet may be detached from the one region and move along a lower route of the Y-shaped polydopamine channel due to its weight. Depending on the kinds of the first and the second materials, the first and the second materials may be uniformly mixed or reacted with each other in the coalescent water droplet. As a result, the microfluidic device may be used as a microvolume water droplet-based reactor.

Figure 6:
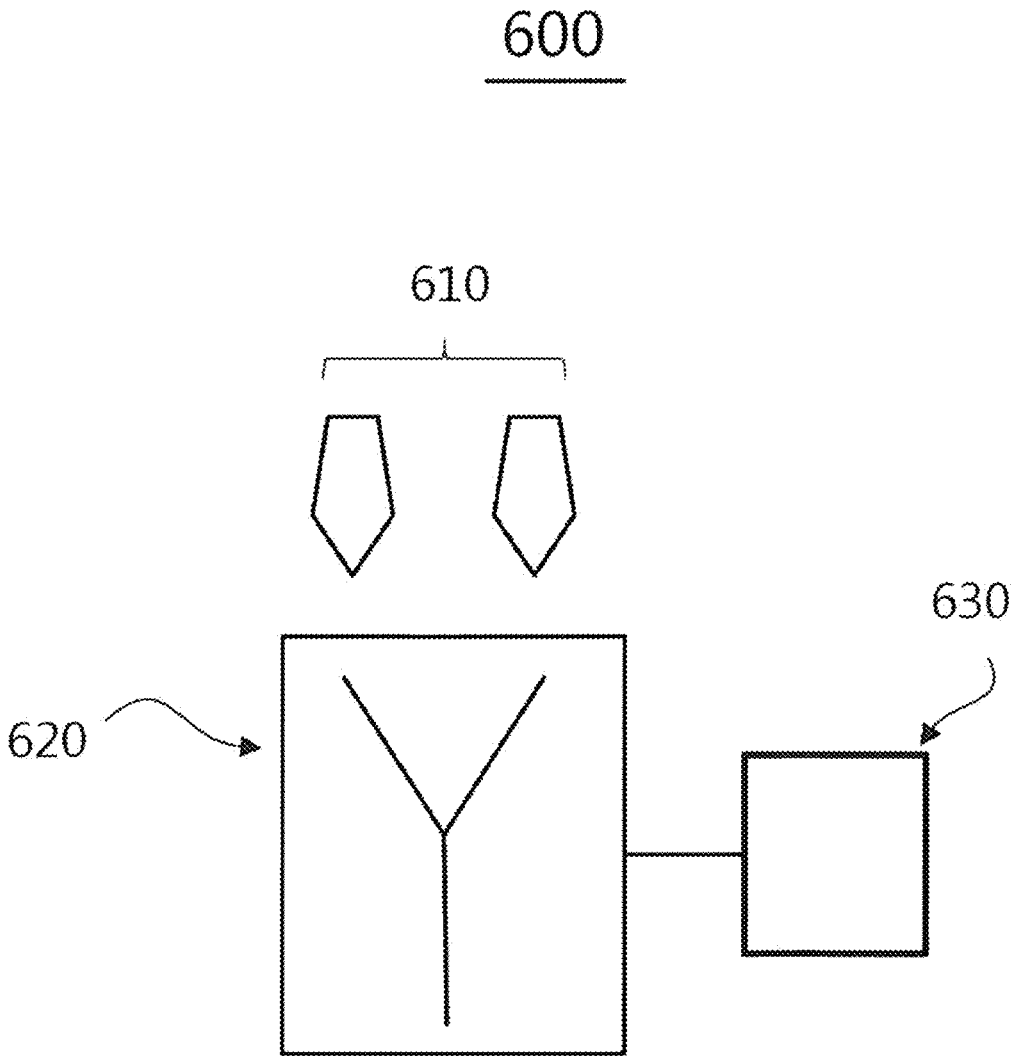
FIG. 6 is a diagram of a microfluidic system according to an exemplary embodiment of the present invention.

According to an exemplary embodiment of the present invention, a microfluidic system including a microfluidic device is provided. FIG. 6 is a diagram of a microfluidic system according to an exemplary embodiment of the present invention. Referring to FIG. 6, a microfluidic system 600 includes a microfluidic device 610, a water droplet provider 620 and an angle stage 630.

The microfluidic device 610 may include a superhydrophobic surface on which a hydrophilic channel is patterned to move a water droplet maintaining a superhydrophobic angle of the water droplet. One part of the hydrophilic channel may include a droplet capturing surface area having a longer edge length in contact with the water droplet than an edge length of the hydrophilic channel in order to stop and fix the moving water droplet.

The water droplet provider 620 may provide a water droplet on the microfluidic device 610, and when the hydrophilic channel has a plurality of routes, the water droplet provider 620 may provide various kinds of water droplets to respective routes.

The angle stage 630 modulates an angle of the microfluidic device 610 for a water droplet to move clue to gravity.

According to the present invention, it is possible to exactly pattern a hydrophilic material such as polydopamine on a superhydrophobic surface in a desired shape. It is possible to prepare an on-surface microfluidic device moving a water droplet in a desired direction on a superhydrophobic surface by coating hydrophilic material to have a micrometer-level line width on the superhydrophobic surface. One of the limit of a conventional complicated 3-D microfluidic device, complexity in fabrication, may be easily overcome by using the technique of moving a water droplet on a surface. In the device of the present invention, a driving force of moving a water droplet is gravity created by a slope of the surface. Moreover, this is a very environmentally friendly technique because a water droplet slidingly moves on a hydrophilic material-coated line, and thus a superhydrophobic angle can be maintained and loss of the water droplet can be minimized.

When the microfluidic device of the present invention is used, the fluid movement can be controlled in units of water droplets. In addition, water flow can be continued or stopped by modulating a slope of the microfluidic device or a width of the hydrophilic channel. When a nanoparticle is synthesized using the above-described microfluidic device, a water droplet-based reaction may produce a nanoparticle having uniform size distribution, and thus a simple biochemical or chemical reaction on a surface may be achieved more easily and rapidly. As a result, the microfluidic device of the present invention may be applied as a microvolume water droplet-based reactor.

According to some embodiments, "water droplet" in this specification may be extended to "hydrophilic liquid droplet". In this case, a hydrophilic liquid may unlimitedly include an alcohol, an amine, a carboxylic acid, a ketone as well as a water. The hydrophilic liquid may be a pure liquid or a solution containing some materials.

Hereinafter, the present invention will be described with reference to examples, but the present invention is not limited thereto.

EXAMPLE 1

Preparation of Superhydrophobic Surface

To prepare a superhydrophobic surface, an AAO membrane was prepared. First, an aluminum surface was washed with acetone for 5 minutes, and electropolished in a mixed solution of perchloric acid and ethanol ($HClO_4$:$C_2H_5OH$=1:4, volume ratio). The electropolished surface was subjected to 1st anodization in a 70.9 M phosphate solution for 6 hours at 120 V. The 1st anodized membrane was dipped in a solution of 1.8 wt % chromic acid ($H_2CrO_4$) and 6 wt % phosphate at 65° C. for 3 hours. The treated membrane surface was subjected to 2nd anodization for 30 minutes under the same conditions as the 1st anodization. The resulting membrane surface was dipped in a 5 wt % phosphate solution at 45° C. for 30 minutes. Finally, the anodized aluminum membrane was treated with oxygen plasma for 10 minutes, and vapor-deposited with a fluorine compound, (tridecafluoro-1,1,2,2-tetrahydrooctyl)trichlorosilane.

EXAMPLE 2

Coating Superhydrophobic Surface with Hydrophilic Polydopamine Material in Y Shape Hydrophilic polydopamine was coated on a superhydrophobic surface obtained in Example 1 in a Y shape using a positive photoresist, AZ-5214 (AZ Electronic Materials, UK) by photolithography as shown in FIG. 2. The AZ-5214 material was spin-coated first on the superhydrophobic surface (7 cm×3 cm) at 5000 rpm for 35 seconds. The spin-coated surface was soft-baked at 110° C. for 2 minutes and exposed to UV rays (365 nm, I-line) for 30 seconds. The obtained surface was developed in an MIR-300 solution for 50 seconds. The surface patterned by AZ-5214 was dipped in a dopamine solution (10 mg/ml, TRIS buffer, pH 8.5) to perform coating for 6 hours. To remove photoresists remaining on the surface after being coated with polydopamine, a superhydrophobic surface was dipped in acetone and then taken therefrom.

Through the above-described procedures, a superhydrophobic surface having different polydopamine line widths (60 μm, 80 μm, 120 μm and 180 μm) was prepared.

EXAMPLE 3

Figure 7:
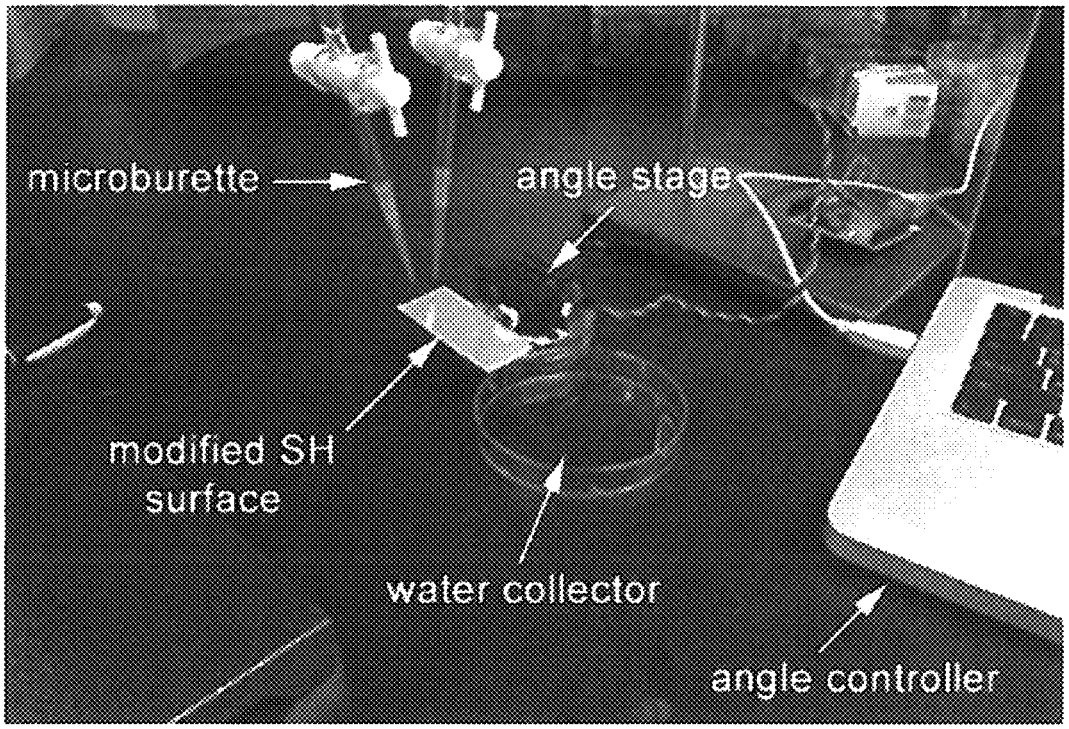
FIG. 7 is an image of a microfluidic system using a polydopamine-coated superhydrophobic surface.

Design of Microfluidic System Using Polydopamine-Coated Superhydrophobic Surface To apply a polydopamine-coated superhydrophobic surface of Example 2 as an on-surface microfluidic device, a system composed of a microburette, an angle stage modulating a surface slope, a water collector and a computer was prepared as shown in FIG. 7. Water may be continuously dropped in a constant volume through a microburette, and the modified superhydrophobic surface may be tilted at a desired angle by the angle stage.

TEST EXAMPLE 1

Measurement of Contact Angle of Water with Respect to Superhydrophobic Surface Coated with Polydopamine in Various Line Widths A water droplet of 10 μl was put on polydopamine coatings having different widths of 80, 120 and 180 μm, and a contact angle was measured using a Phoenix 300 goniometer (Surface Electro Optics Co., Ltd, Korea). As the result of measuring the contact angle, a contact angle measured on the superhydrophobic surface which was not modified by polydopamine was 154 degrees, a contact angle measured on the 80 μm polydopamine coating was 152.1 degrees, a contact angle measured on the 120 μm polydopamine coating was 150.9 degrees, and a contact angle measured on the 180 μm polydopamine coating was 150.0 degrees. It was confirmed that all of the contact angles were maintained as a superhydrophobic angle of 150 degrees or higher when micrometer-level line coating was performed using Polydopamine.

TEST EXAMPLE 2

Measurement of Maximum Static Traction of Water Droplet on Polydopamine Line Coating To examine how strong a traction force was exerted on a water droplet by a polydopamine line coated on a superhydrophobic surface, the maximum traction of the water droplet was measured on the polydopamine line coating.

After various volumes of water droplets were put on the polydopamine line coated on the superhydrophobic surface, variation in a surface slope was continuously given by 1 degree per 0.2 seconds, and a critical angle $\theta_{cr}$ at which a water droplet started rolling down was recorded with a computer, thereby calculating the maximum traction.

Figure 8:
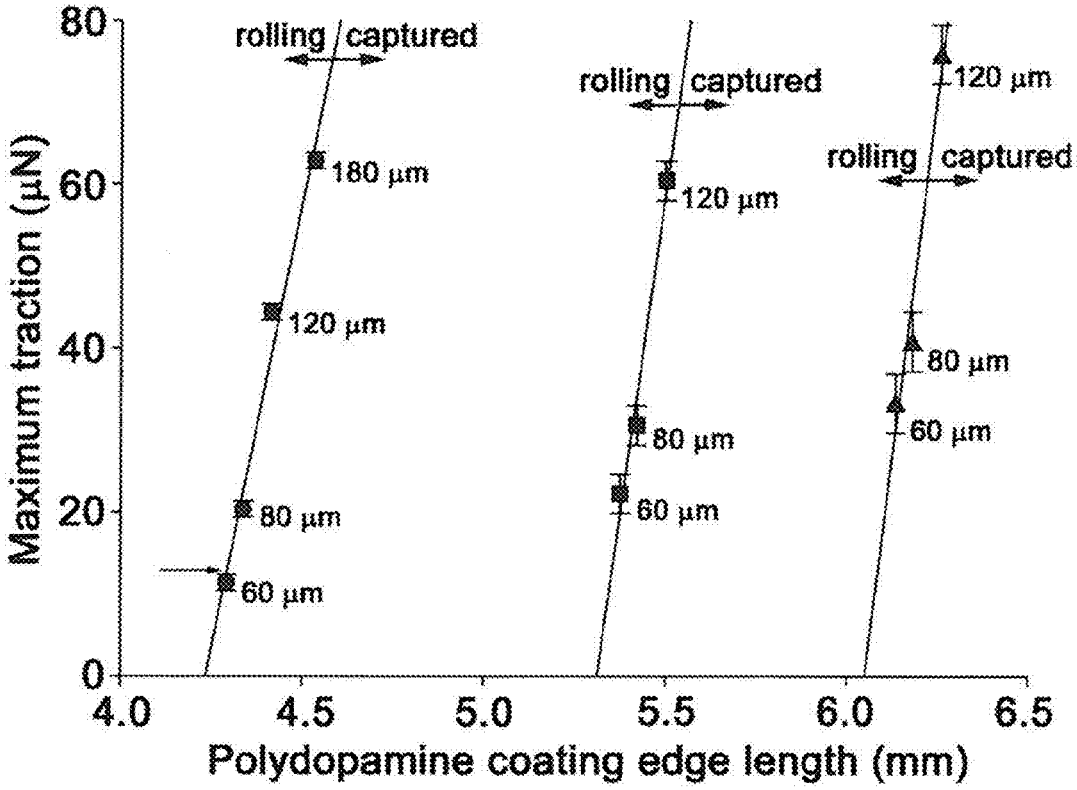
FIG. 8 illustrates the relationship between a maximum static traction calculated from Equation 1 and an edge length of a water droplet contacted polydopamine coating.

FIG. 8 illustrates the relationship between a maximum static traction calculated from Equation 1 and an edge length of a water droplet contacted polydopamine coating. Volumes of water droplets used for the experiment were 10 μl (circle), 20 μl (square) and 30 μl (triangle). In addition, "60 μm", "80 μm", "120 μm" and "180 μm" indicate widths of the polydopamine channel coated on the superhydrophobic surface.

The edge length of the water droplet contacted polydopamine coating increases with increasing a coating width of the coated polydopamine. It can be seen from FIG. 8 that all of the maximum tractions with respect to water droplets having different volumes (10, 20 and 30 μl) are proportional to the edge length of the water droplet contacted polydopamine coating. It shows that as the polydopamine coating line width increases, a traction force exerted to a water droplet increases.

TEST EXAMPLE 3

Test of Controlling Fluid Flow (Movement and Fixation) on On-Surface Microfluidic Device Y-shaped polydopamine line coating (width: 60 μm) was performed on a superhydrophobic surface as described in Example 2. Here, a polydopamine patch having a size of 200 μm (width)×200 μm (length) was coated in the middle of the Y-shaped polydopamine coating, thereby forming a droplet capturing surface area. To apply the obtained surface as an on-surface microfluidic device, a system composed of a microburette continuously dropping the same volume of water droplets, an angle stage modulating a slope of the surface, a water collector and a computer was prepared as shown in FIG. 7.

Figure 9:
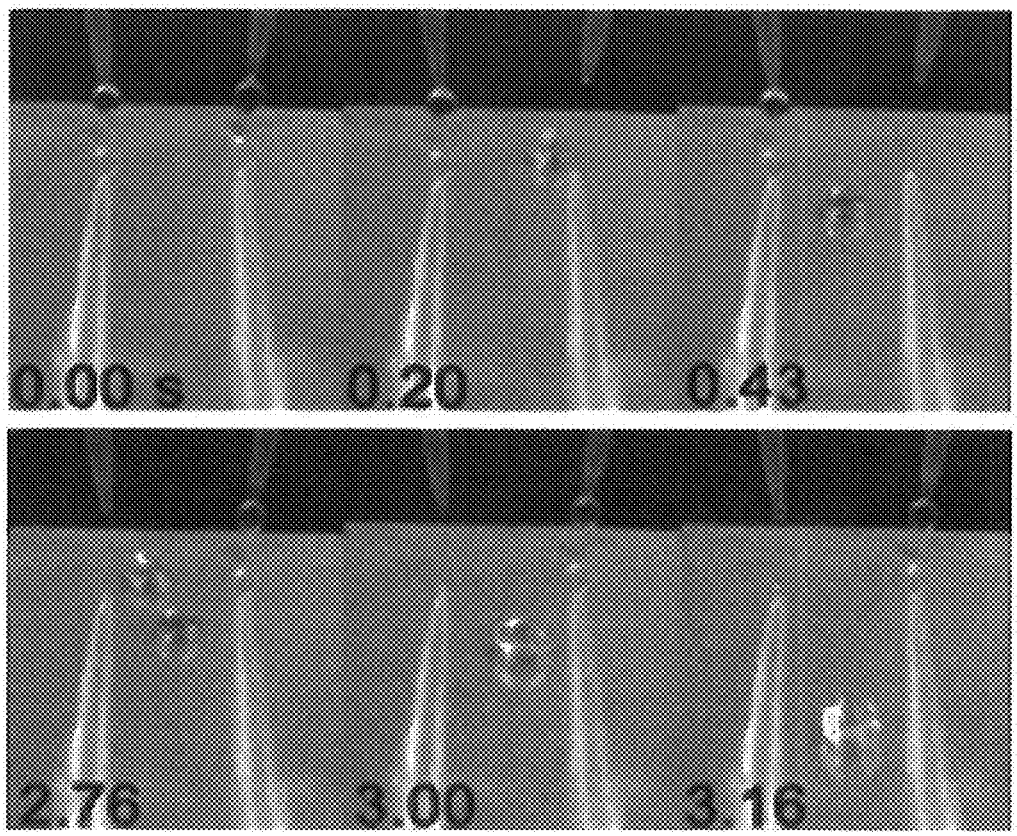
FIG. 9 illustrates images of water droplet movement after falling according to time.

Two water droplets were sequentially dropped using two microburettes at different times at two starting points that the Y-shaped polydopamine coating starts, and a high-definition moving image of the movement of the water droplets was imaged using the system. FIG. 9 is an image of movement of water droplets after they were dropped. A volume of the water used was 10 μl, and a surface slope was 5 degrees. Referring to FIG. 9, a water droplet dropped first from the right microburette of FIG. 9 moved for 0.43 seconds and then was captured by the polydopamine patch coated in the middle of the Y shape and fixed. A water droplet subsequently dropped from the left microburette met the fixed water droplet at 3.00 seconds, and because a weight of the combined water droplet exceeded a force exerted by the polydopamine patch, the coalescent water droplet rolled down.

TEST EXAMPLE 4

Synthesis of Water Droplet-Based Gold Nanoparticle Using On-Surface Microfluidic Device A gold nanoparticle was obtained by a water droplet based synthesis using an on-Surface microfluidic device. 10 μl of a $HAuCl_4$ water droplet (2 mM) was dropped from one of two microburettes, and 10 μl of a $NaBH_4$ water droplet was continuously dropped from the other microburette. For a kinetic analysis of the gold nanoparticle synthesis, movement of water droplets for synthesizing a gold nanoparticle was captured with a super high speed camera. Red (R), green (G) and blue (B) signal values of each water droplet were measured using a color extraction tool of Photoshop, and a R/(G+B) value was traced throughout the time of 250 milliseconds.

Figure 10:
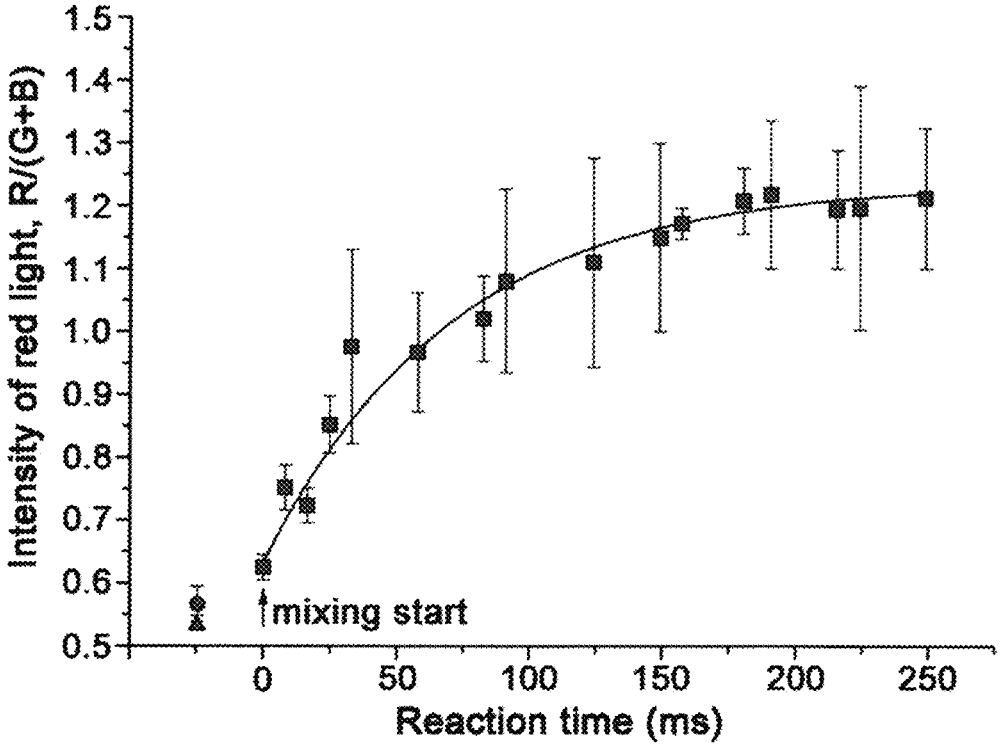
FIG. 10 illustrates a graph dynamically analyzing a process of gold nanoparticle synthesis according to reaction time.

FIG. 10 illustrates a graph dynamically analyzing a process of gold nanoparticle synthesis according to reaction time. R/(G+B) value was measured from when a coalescent water droplet prepared by combining a water droplet of $HAuCl_4$ solution (2 mM) and a water droplet of $NaBH_4$ solution (10 mM) started to roll down. Referring to FIG. 10, it can be seen that synthesizing a gold nanoparticle is a fast reaction approaching equilibrium state at an early stage since R/(G+B) value does not change after 200 milliseconds.

Gold nanoparticles were continuously synthesized on the on-surface microfluidic device, thereby obtaining 14 ml of a final product for 8 minutes and then size distribution of the gold nanoparticles was examined through Transmission Electron Microscopy (TEM) analysis. As a control test to compare with this test result, 7 ml $HAuCl_4$ solution was mixed with 7 ml $NaBH_4$ solution in a bulk phase, a reaction was performed for 8 minutes, and then size distribution of gold nanoparticles was examined through TEM analysis.

Figure 11:
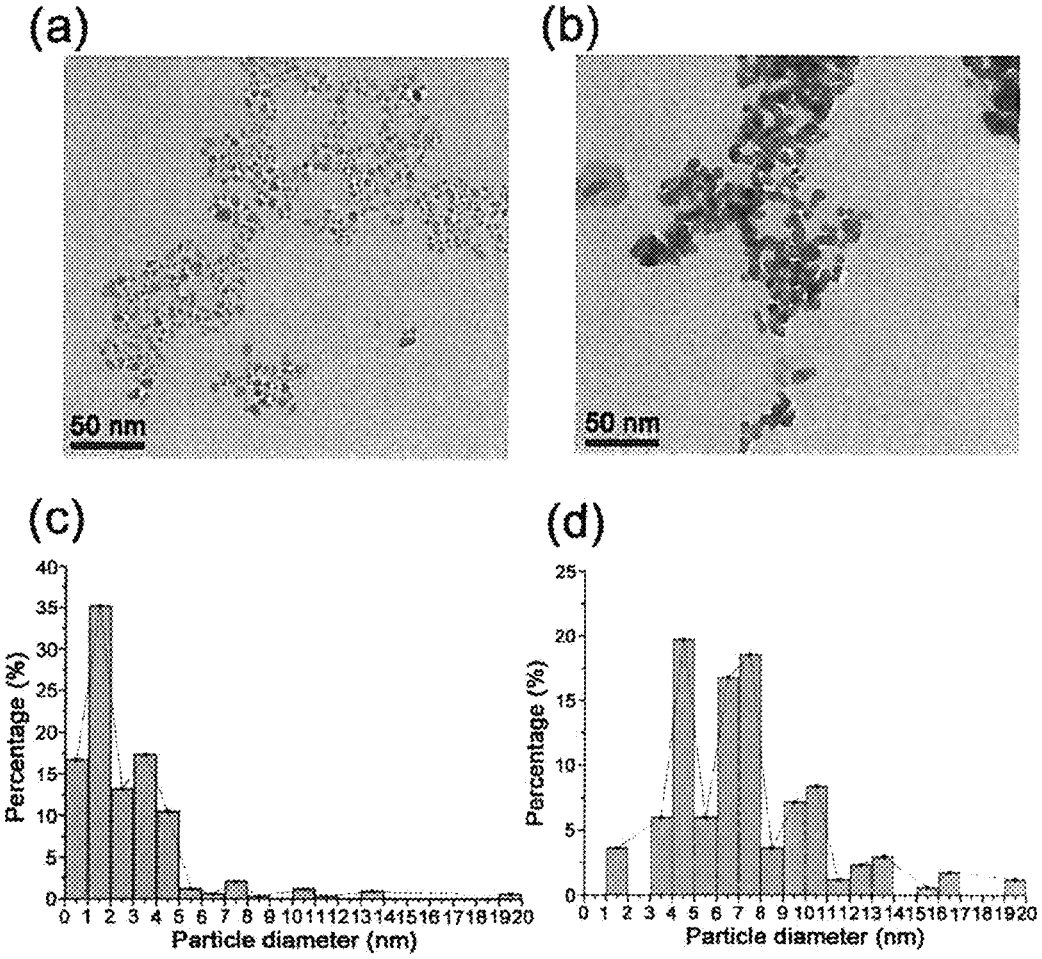
FIG. 11 illustrates transmission electron microscope (TEM) images and size distribution graphs to compare size distributions of gold nanoparticles obtained by a water droplet reaction and a bulk reaction.

FIG. 11 illustrates TEM images and size distribution graphs to compare size distributions of gold nanoparticles obtained by a water droplet reaction and a bulk reaction. (a) is a TEM image of gold nanoparticles obtained by the water droplet reaction using the on-surface microfluidic device, and (b) is a TEM image of gold nanoparticles obtained by the bulk reaction. (c) is a size distribution graph of gold nanoparticles obtained by the water droplet reaction, and (d) is a size distribution graph of gold nanoparticles obtained by the bulk reaction.

The results of the analysis showed that, while the gold nanoparticles obtained by the water droplet reaction using the on-surface microfluidic device have a relatively uniform size distribution of 1 to 5 nm, the gold nanoparticles obtained by the bulk reaction have non-uniform size distribution of 1 to 14 nm. As a result, it can be seen that, compared to the bulk-phase synthesis reaction, the synthesis of gold nanoparticles using the microfluidic device can obtain particles having more uniform size distribution.

While the exemplary embodiments have been described in detail, it will be understood by those skilled in the art that various changes in form and details may be made therein without departing from the scope of the invention as defined by the appended claims.

What is claimed is:

1. A method of controlling water droplet movement, comprising:

providing a substrate including a superhydrophobic surface on which a hydrophilic 2-D channel to guide water droplet movement is patterned;

introducing a water droplet on the substrate; and modulating a slope of the superhydrophobic surface for the water droplet to move on the superhydrophobic surface along the hydrophilic 2-D channel, wherein a width of the hydrophilic 2-D channel is designed for the water droplet to move on the superhydrophobic surface, with maintaining a superhydrophobic angle, the superhydrophobic surface being tilted with respect to a ground, wherein the width of the hydrophilic 2-D channel ranges from 60 to 180 μm.

2. The method according to claim 1, wherein the water droplet movement is caused by gravity.

3. The method according to claim 1, wherein the hydrophilic channel includes a monomeric or a polymeric coating of hydroxybenzenes or catecholamines.

4. The method according to claim 1, wherein the water droplet maintains a contact angle of 120 degrees or higher on the superhydrophobic surface.

5. The method according to claim 1, wherein the hydrophilic 2-D channel is composed of polydopamine.

6. A method of controlling water droplet movement, comprising:

providing a substrate including a superhydrophobic surface on which a hydrophilic 2-D channel to guide water droplet movement is patterned;

introducing a water droplet on the substrate; and modulating a slope of the superhydrophobic surface for the water droplet to move on the superhydrophobic surface along the hydrophilic 2-D channel, wherein, a width of the hydrophilic 2-D channel is designed for the water droplet to move on the superhydrophobic surface having a certain angle with respect to a ground, and a part of the hydrophilic 2-D channel includes a droplet capturing surface area which has a longer edge length in contact with the water droplet than that of the hydrophilic 2-D channel in order to stop and fix the moving water droplet.

7. The method according to claim 6, wherein another water droplet besides the water droplet moves along the hydrophilic channel to be coalesced with the water droplet in the droplet capturing surface area, and the coalescent water droplet formed in the droplet capturing surface area starts to move from the capturing surface area due to a weight increase of the coalescent water droplet and moves along the remaining hydrophilic channel.

8. A method of controlling water droplet movement, comprising:

providing a microfluidic device in which a Y-shaped 2-D catecholamine channel is patterned on a superhydrophobic surface; and moving a first water droplet including a first material and a second water droplet including a second material along respective routes of the Y-shaped 2-D catecholamine channel due to gravity with maintaining a superhydrophobic angle of the first and second water droplets, wherein, the Y-shaped 2-D catecholamine channel includes a Y-shaped route for inputting each of the first and second water droplets and outputting a coalescent water droplet formed by combination of the first and second water droplets, and one of the first and the second water droplets is first captured on a specific region of the Y-shaped 2-D catecholamine channel, the other water droplet is combined with the previously captured water droplet, and the coalescent water droplet moves along a lower route of the Y-shaped 2-D catecholamine channel, wherein a width of the Y-shaped 2-D catecholamine channel ranges from 60 to 180 μm.

9. The method according to claim 8, wherein the first and the second materials are uniformly mixed or reacted with each other in the coalescent water droplet.

10. A method of controlling water droplet movement, comprising:

providing a substrate including a superhydrophobic surface on which a first hydrophilic channel and a second hydrophilic channel meeting each other at one point, and a third hydrophilic channel connected with the first and the second hydrophilic channels through the one point are patterned;

dropping a first water droplet and a second water droplet on the first hydrophilic channel and the second hydrophilic channel, respectively; and modulating a slope of the superhydrophobic surface to move the first and the second water droplets in a direction of the third hydrophilic channel along the first and the second hydrophilic channels, wherein the third hydrophilic channel includes a droplet capturing surface area capable of stopping and fixing the first or the second water droplet, and the first and the second water droplets are combined with each other on the droplet capturing surface area to form a third water droplet.

11. The method according to claim 10, wherein the third water droplet is immediately detached from the droplet capturing surface area after being formed and moves along the third hydrophilic channel.

12. The method according to claim 10, wherein a coalescent water droplet formed by combining another water droplet with the third water droplet is detached from the droplet capturing surface area and moves along the third hydrophilic channel.

13. A microfluidic device comprising:

a superhydrophobic surface; and a hydrophilic channel patterned on the superhydrophobic surface to move the water droplet due to gravity maintaining a superhydrophobic angle of a water droplet, wherein the hydrophilic channel includes a Y-shaped route for inputting each of two water droplets and outputting a coalescent water droplet formed by combination of the two water droplets; and one region of the route includes a droplet capturing surface area capable of fixing one of the two water droplets that first reaches the droplet capturing surface area, detaching a coalescent water droplet formed by combining the fixed water droplet and the other water droplet that arrives later due to a weight of the coalescent water droplet, and outputting the coalescent water droplet along the Y-shaped route.

14. The microfluidic device according to claim 13, wherein an edge length of the hydrophilic channel in contact with the water droplet is modulated in order to control movement and fixation of the water droplet.

15. The microfluidic device according to claim 13, wherein the edge length is increased as a width of the hydrophilic channel is increased.

16. A microfluidic system comprising:

a microfluidic device including a superhydrophobic surface on which a hydrophilic channel is patterned to move the water droplet maintaining a superhydrophobic angle of a water droplet;

a water droplet provider for providing a water droplet on the microfluidic device; and an angle stage modulating a slope of the microfluidic device to move the water droplet due to gravity, wherein one part of the hydrophilic channel includes a droplet capturing surface area having a longer edge length in contact with the water droplet than an edge length of the hydrophilic channel in order to stop and fix the moving water droplet.

17. A method of controlling hydrophilic liquid droplet movement, comprising:

providing a substrate including a superhydrophobic surface on which a hydrophilic 2-D channel to guide hydrophilic liquid droplet movement is patterned;

introducing a hydrophilic liquid droplet on the substrate; and modulating a slope of the superhydrophobic surface for the hydrophilic liquid droplet to move on the superhydrophobic surface along the hydrophilic 2-D channel, wherein a width of the hydrophilic 2-D channel is designed for the hydrophilic liquid droplet to move on the superhydrophobic surface having a certain angle with respect to a ground, wherein the width of the hydrophilic 2-D channel ranges from 60 to 180 μm.

18. The method according to claim 17, wherein the hydrophilic 2-D channel is composed of a monomeric or a polymeric coating of hydroxybenzenes or catecholamines.

* * * * *